US007857655B2

(12) United States Patent
Gyagang et al.

(10) Patent No.: US 7,857,655 B2
(45) Date of Patent: Dec. 28, 2010

(54) INSULATION DISPLACEMENT CONTACT AND CONTACTING DEVICE

(75) Inventors: Tensing Gyagang, Horgen (CH); Reimar Grosskopf, Uster (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 12/500,100

(22) Filed: Jul. 9, 2009

(65) Prior Publication Data

US 2010/0009567 A1 Jan. 14, 2010

(30) Foreign Application Priority Data

Jul. 11, 2008 (CH) ..... 1078/08

(51) Int. Cl.
*H01R 11/20* (2006.01)

(52) U.S. Cl. ..... 439/404; 439/409; 439/417

(58) Field of Classification Search ..... 439/404, 439/409, 417
See application file for complete search history.

(56) References Cited

U.S. PATENT DOCUMENTS

| | | | | |
|---|---|---|---|---|
| 4,580,870 | A * | 4/1986 | Gerke | 439/816 |
| 4,591,225 | A * | 5/1986 | Squitieri | 439/404 |
| 5,044,979 | A * | 9/1991 | Siemon et al. | 439/404 |
| 5,118,305 | A | 6/1992 | Hell et al. | |
| 5,620,332 | A | 4/1997 | Gerke et al. | |
| 5,651,691 | A | 7/1997 | Grumel | |
| 5,685,733 | A | 11/1997 | Janczak | |
| 5,722,850 | A * | 3/1998 | White | 439/404 |
| 5,800,200 | A * | 9/1998 | Brioaud et al. | 439/404 |
| 6,126,457 | A * | 10/2000 | Smith et al. | 439/76.2 |
| 6,222,717 | B1 * | 4/2001 | Waas et al. | 361/119 |
| 6,478,605 | B2 | 11/2002 | Stuckmann et al. | |
| 6,796,830 | B2 | 9/2004 | Suss et al. | |
| 7,048,571 | B2 | 5/2006 | Wilinski | |
| 7,344,404 | B2 | 3/2008 | Wilinski | |
| 7,572,140 | B2 | 8/2009 | Szelag et al. | |
| 2001/0044232 | A1 | 11/2001 | Reichle | |

FOREIGN PATENT DOCUMENTS

| | | | |
|---|---|---|---|
| CA | 2425376 | A1 | 4/2003 |

(Continued)

*Primary Examiner*—Truc T Nguyen
(74) *Attorney, Agent, or Firm*—Rankin, Hill & Clark LLP

(57) ABSTRACT

An insulation displacement contact (1) according to the invention essentially distinguishes itself in that as a whole it comprises a cutter section with two opposing contact blades (3.1, 3.2) together with two fork sections which contribute to a clamping force with which the two contact blades are pressed together as soon as a conductor is inserted between the contact blades and they are pushed away from one another. In the process one fork (4) exerts proximally (i.e. on the side, from which the conductor is inserted) and the other fork (5) distally (i.e. on the side opposite), such that the two contact blades are pushed together at four points. The fork sections are angled relative to the cutter section (3), i.e. they do not run in the same plane as the cutter section. The two fork sections each constitute an independent, elastic spring. This means that in they will be substantially elastically and not plastically deformed as a result of the moving-apart of the contact blades (3.1, 3.2) to the thickness of a conductor to be contacted.

17 Claims, 4 Drawing Sheets

FOREIGN PATENT DOCUMENTS

| | | | |
|---|---|---|---|
| DE | 19909825 | A1 | 9/2000 |
| DE | 19921775 | A1 | 11/2000 |
| DE | 10054290 | A1 | 5/2002 |
| DE | 20312123 | U1 | 10/2003 |
| DE | 10347668 | A1 | 5/2005 |
| DE | 102004024790 | A1 | 12/2005 |
| DE | 202005012792 | U1 | 3/2006 |
| DE | 102006039799 | B3 | 11/2007 |
| EP | 0344526 | A2 | 12/1989 |
| EP | 0665614 | A2 | 10/1994 |
| EP | 0684662 | A1 | 11/1995 |
| EP | 0706234 | B1 | 11/1999 |
| EP | 0991149 | A2 | 4/2000 |
| EP | 1001489 | A2 | 5/2000 |
| EP | 1191634 | A2 | 3/2002 |
| EP | 1251589 | A1 | 10/2002 |
| EP | 1289066 | A2 | 3/2003 |
| GB | 2028012 | A | 2/1980 |
| WO | 01/78193 | A2 | 10/2001 |

* cited by examiner

Fig. 5
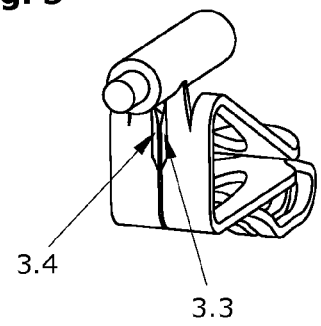
Fig. 6
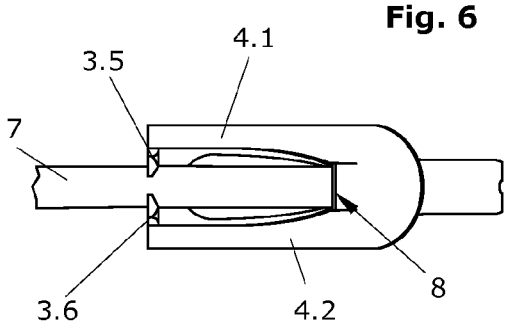
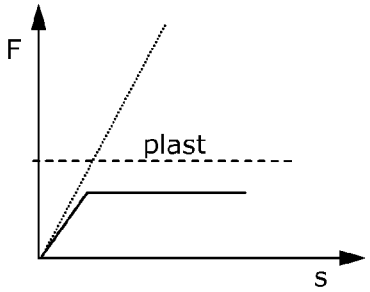
Fig. 7
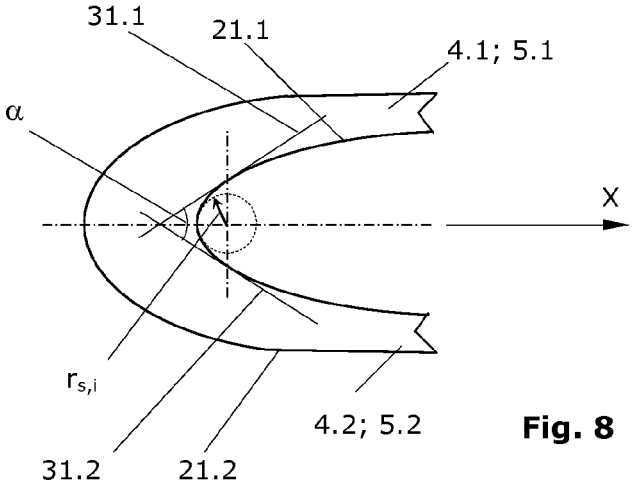
Fig. 8
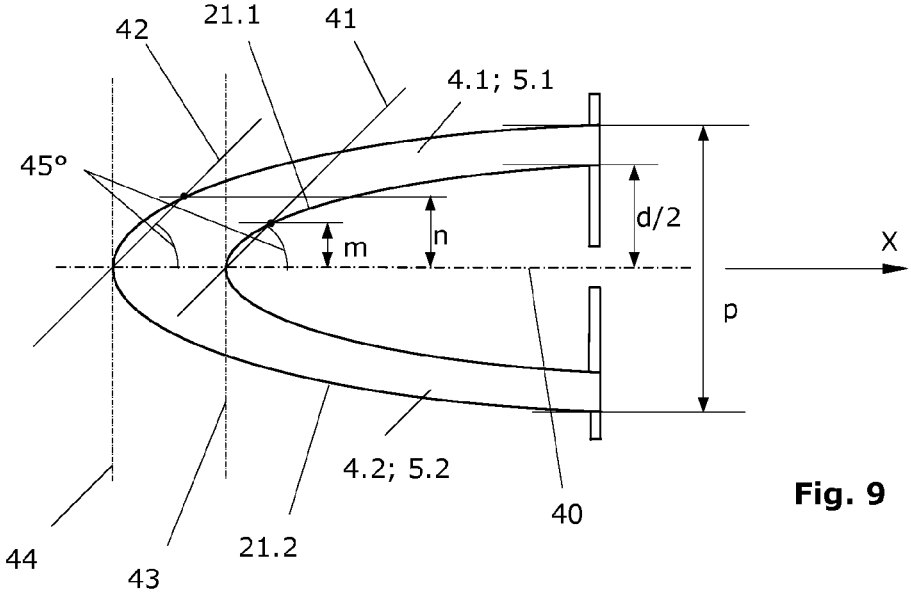
Fig. 9

INSULATION DISPLACEMENT CONTACT AND CONTACTING DEVICE

BACKGROUND OF THE INVENTION

1. Field of the Invention

The invention relates to the electrical contacting of insulated conductors by means of an insulation displacement contact. In particular, the invention relates to an insulation displacement contact and a contacting device with an insulation displacement contact.

2. Description of Related Art

For the electrical contacting of cable strands (insulated stranded cable conductors or wires), electrically conductive terminals are often used, which can be clamped onto and form an electrical contact with a contacting region of the conductor, which has been de-insulated in a previous step. In addition to these, insulation-piercing technologies are well known. These have to do with electrically conductive contacting elements, which are designed such that they can break through the electrical insulation at the contacting site and contact the underlying conductor without prior de-insulation. The best-known in this regard are the insulation displacement contacts (IDC), in which the cable strands are pressed between two blades in an area of the contact that is furnished with a bifurcated, bladed area, until the insulation is cut through, whereby not only is the conductor contacted, but the cable strand is also held fast at the same time. Also well known are the so-called piercing contacts, with which the insulation is punctured by at least one contacting point.

While the piercing contacts require a separate, independent cable strand holder, insulation displacement contacts are self-centering and have been widely tested and proven. The known insulation displacement contacts, as described for example in the introductory paragraph of U.S. Pat. No. 6,866,536, are however as a rule only appropriate for use with conductors that have a precise pre-defined diameter and a small range on either side of this diameter. In addition, they require a sizeable installation height and in most embodiments can only create a contact from one conductor to one other. Moreover, in general they are only appropriate for a single wiring of a conductor or at most only a very few wiring procedures, since they may be considerably plastically deformed when the cable strand is inserted between the blades. The extent of the plastic deformation depends in many cases upon how deeply the cable strand, and with it the conductor, is inserted between the blades of the IDC, so that the already limited degree of re-usability is also an unpredictable value.

An electrical terminal with an insulation displacement contact which is appropriate for the simultaneous contacting of two conductors is disclosed in DE 1990 98 25 or DE 20 2005 012 792 U. For this purpose, the insulation displacement contact is formed as a pincer-shaped (or dredging-shovel-like) curved insulation displacement contact (bended stamped piece), wherein the depth of the pincers created thereby (corresponding to the length of the curved insulation displacement contactor) is large enough to allow the inclusion of two conductors. This solution, thus, has the advantage that in contrast to conventional insulation displacement contacts, the spring force that is exerted on the conductor is not a function of the depth to which it is introduced; this first makes possible the simultaneous introduction of two equally thick (in cross section) conductors. However, it is disadvantageous that in this design a larger material strength is assumed, or the contact strength is relatively limited in relation to the overall size, and that the spring force is given by the thickness of the plate, and thus is a parameter that can only be manipulated— with little flexibility—through the thickness and selection of the material. Furthermore, the installation height of one of these insulation displacement contacts is relatively large, so that although it is appropriate for use in the terminal described in DE 20 2005 012 792 U, it is problematic when used with well-known plug systems. Furthermore, this design is not appropriate for the wiring of through-running cable strands.

EP 0 344 526 depicts a terminal block for a cable jack with a clip which is set into an insulating body. The clip exhibits on one side a terminal contact and on the other side a separation or clamping mechanism. In one embodiment, a bipartite connection piece connects proximally between the terminal contact and the V-shaped clamp mechanism to the terminal contact. The arrangement is however not appropriate for the introduction of an elastic spring force through the clamping mechanism such that a plastic deformation will occur during the insertion of a conductor. In addition, the clamps require a substantial installation height. Furthermore, due to the arising plastic deformation, they are in general only appropriate for a single wiring of a conductor or at the most only very few wiring procedures.

BRIEF SUMMARY OF THE INVENTION

It is the object of the invention to provide an insulation displacement contact for joining, which overcomes the disadvantages of the state of the art and which in particular is appropriate for the multiple wiring of multiple conductors (advantageously with different conductor cross sections) one after the other. Solutions which actually enable the wiring together of cable strands with different diameters are preferred. A further object of the invention is the provision of a corresponding contacting device.

These objects will be fulfilled by the invention, as defined in the patent claims.

An insulation displacement contact according to the invention is substantially characterized in that as a whole it includes a cutter section with two opposing contact blades next to two fork sections, which both account for a clamping force, with which the two contact blades (during the wiring) are pushed against each other, as soon as a conductor is inserted between the contact blades and these are thereby pushed away from one another. Therein—with respect to a wiring direction, i.e. for example in a direction running parallel to the cutting edge of the blade, in which the conductor is moved between the blades while being pressed in—the one fork engages proximally (i.e. on the side from which the conductor is introduced) and the other fork distally (i.e. on the opposite side), such that the two contact blades are pressed together at four points. The fork sections are angled to the cutter section, i.e. they do not run in the same plane as the cutter section.

That the fork sections form an angle with the cutter section does not mean that they necessarily must be partially or entirely flat. In addition, it is not excluded that at least one of the sections forms an angle of 180° to the fork and thereby is parallel to it. Rather here 'forms an angle' means only that the respective fork section and the cutter section do not extend in a common plane and preferably also do not extend parallel to one another in the same direction (i.e. the respective fork section is not angled in a parallel plane and back in the same direction). As described in detail below, preferably (in different configurations) the two fork sections are bent at least 90°, such that the installation height of the physical dimension of the cutter section corresponds to and at least does not substantially exceed these.

The two fork sections each have the function of an elastic spring, and preferably they are arranged such that they are linked by the cutter section in the case of an appropriately modulated insertion of a conductor, and for example, do not individually function as supplementary clamps; this would impair the spring action and also preclude an ideal spring form, which is discussed below in more detail.

The fork sections are arranged such that each of them works from one side as a spring clamp. Each of the two fork sections, thus, constitutes for itself an independent elastic spring. This means that in the pushing apart of the contact blades to a thickness of one of the conductors to be contacted, in the area of the proximal bending line (i.e. the line at which the cutter section merges into the first fork section) as well as in the region of the distal bending line (i.e. the line at which the cutter section merges into the second fork section) the first as well as the second fork is substantially elastically and either not, or else to a very small extent when compared to the elastic deformation, plastically deformed.

This also means that in general, during the insertion of the conductor, the contact blades do not (or at most not substantially) open in a V-shaped manner with an opening angle that increases with the insertion depth; on the contrary: preferably during insertion the contact blades remain approximately parallel to one another (or even eventually assume a configuration slightly opened to the distal side as the conductor is positioned in a distal region). The deflection of the fork spring is therefore essentially only dependent on the diameter of the conductor and not on the position of the conductor between the contact blades.

For this purpose, the spring constants of the two springs formed by the first as well as the second forks are of a similar order of magnitude (if one takes as a benchmark the force needed for a deflection in the area of the respective bending line), i.e. the spring constants are dissimilar at most by a factor of 3 (i.e. $1/3F_1<F_2<3F_1$), preferably at most by a factor of 2, and particularly preferably they are substantially the same, i.e. they differ from one another at most by a factor of 1.5. Ideally the two spring constants are practically identical, i.e. they differ from one another by at most about 20%.

These criteria can be realized particularly well if the prongs of the first fork are approximately the same length as the prongs of the second fork. For example, the lengths are at most 50% and particularly preferably at most 30% different from one another.

According to a preferred embodiment the forms of the two forks are optimized for as large as possible of an elastic area in relation to the length of the forks, which also means that they can store a comparatively large amount of potential energy. Conventional insulation displacement contacts have in the region of the bridge between the blades an approximately circumferential inner contour line, to which a region adjoins, in which two parallel fork prongs are formed. The outer contour line of conventional insulation displacement contacts is often sectionally rectangular with rounded edges. It has been shown however that such a form is not optimal, because in the area of the bridge very high forces appear, which result in permanent (plastic) deformations. Although the invention does not exclude such forms, a geometry of the two forks that differs from this is recommended. Preferably the forks are formed such that in a deflection, an (elastic) deformation does not only occur in the bridge, but rather the whole length of the fork contributes to the storage of potential energy. In particular, it is preferred that at least one, preferably more than one of the following design criteria are realized:

An inner contour line of the corresponding fork is symmetrical relative to a plane of symmetry through the apex, and a distance m, defined as the distance from the plane of symmetry to a point of intersection between the inner contour line and a plane perpendicular to the fork plane at an angle of 45° from the plane of symmetry, is such that $m \leqq 3d/8$, where d is the distance between opposing points on the inner contour line at the site of greatest distance between the fork prongs.

An outer contour line of the corresponding fork is symmetrical relative to a plane of symmetry through the apex, and the distance n, defined as the distance from the plane of symmetry to a point of intersection between the outer contour line and a plane through the outer contour line apex and a plane perpendicular to the fork plane and at an angle of 45° from the plane of symmetry, is such that $p/4 \leqq n < p/2$, where p is the distance between opposing points on the outer contour line at the site of greatest distance between the fork prongs.

The corresponding fork has an inner contour line, which at the apex comprises a non-zero radius of curvature $r_{Si}$ and tangents to the inner contour line at a distance of a radius of curvature $r_{Si}$ from the apex, which distance is measured radially to the circle of curvature, will be at an angle different 0° to each other, wherein the angle is preferably at least 10°, at least 20° or at least 30°. In other words, if a line is drawn perpendicular to the plane of symmetry and through midpoint of the circle of curvature at the apex, it will intersect the inner contour line at two points. The tangents to the inner contour line at these two points will themselves intersect to form a non-zero angle, wherein the angle preferably amounts to at least 10°, at least 20° or at least 30°. For example, the inner contour line runs nearly elliptically, i.e. it curves with the greatest curvature in the area of the apex.

The width of the fork prongs steadily decreases as a function of distance from the apex.

The outer contour line runs in a course analogous to, for example, the inner contour line, (it can also be elliptic), wherein at the apex it comprises a non-zero radius of curvature $r_{Sa}$ and if a line is drawn perpendicular to the plane of symmetry and through midpoint of the circle of curvature at the apex, it will intersect the outer contour line at two points. The tangents to the outer contour line at these two points will themselves intersect to form a non-zero angle, wherein the angle preferably amounts to at least 10°, at least 20° or at least 30°.

The outer contour line of the corresponding fork qualitatively has a course that is analogous to the course of the inner contour line, for example the two are substantially elliptical with different ellipse parameters.

If the inner and/or the outer contour lines are parameterized, then the first and preferably also the second derivatives of the coordinates with respect to the parameterizing variables are constant.

The first two mentioned design criteria assume that the contour line is symmetrical. In a general case, in which the corresponding (inner or outer) contour line is not necessarily symmetrical relative to a plane of symmetry, the distance m and/or n is defined as follows: in a blank of an insulation displacement contact those lines are intersected by the inner and/or outer contour lines that comprise an angle of 45° to the tangents of the inner and/or outer apex. The distance from the respective intersection point to the perpendicular of the named tangent corresponds to the value m and/or n, for which the above conditions hold true. In asymmetrical cases the two 45° straight lines can result in different values $m_1$, $m_2$, $n_1$, $n_2$; the above conditions can then respectively be valid for one of these two values or for both. It can also be that the corresponding conditions hold true for only the inner contour line and not for the outer, or vice versa.

The approach according to the invention has the first, direct advantage that with a long enough cutter section two conductors are simultaneously connectable, i.e. a conductor that is clamped in one position does not preclude that sufficient clamping force may be applied to a second conductor that is inserted to another position between the contact blades. This is in some circumstances also true if the two conductors do not have exactly the same diameter.

A second advantage of the approach, according to the invention, arises from the advantage that conductors of different diameters are wireable, and indeed reversible. Thus, it can be that a first, thicker conductor, and after this is removed a second, less thick conductor can be reliably held—because due to the approach according to the invention, practically no plastic deformation occurs, provided that only conductors with a diameter in an approved range of diameters are wired.

The fork sections are preferably designed such that an inserted conductor over an entire length of the cutter part is reversibly clampable, i.e. that the clamping force over the entire length is sufficient but not too great, wherein through insertion of a conductor of an intended size the insulation displacement contact will be deformed substantially elastically.

Furthermore, the design with the angled fork sections enables the use of contacting devices (e.g. plugs, adapters, jacks, etc.) of relatively limited installation height. This is particularly the case if the fork sections are angled at least 90° from each other: then the entire installation height can correspond to the height of the cutter section. Overall, it results in an optimal relationship between installation height and elasticity: despite limited installation height, the blades can be displaced relative to one another with elastic deformation by a comparatively very large amount.

The geometry of contact elements designed according to the invention also makes possible that the insulation displacement contact can be formed as a whole unit with insulation displacement openings situated in opposed directions or as a double contact element with two insulation displacement contact sections at different sites.

Preferably, the insulation displacement contact is designed such that a through-running conductor can be contacted, without needing to be snapped off or even cut. In particular, a conductor that is to be contacted should preferably be contacted substantially (under application of a force) only by the contact blades of the insulation displacement contact; the fork sections can thereby be optimally formed for their function as elastic springs.

According to a particularly preferred embodiment, one of the two fork sections is angled at more than 90°, while the other is angled to approximately 90°. The first, more than 90° angled fork section therein corresponds to the first section, which adjoins the proximal end of the cutter section (i.e. the "upper" fork section). In this preferred embodiment, the wiring of a through-running conductor is possible; the fork bridges of the two fork sections both run "underneath" the conductor.

In a first variant the first and second fork sections are angled to the cutter section such that they, relative to a cutter-section plane, lie on the same side of the cutter section. This configuration makes it possible that without additional requirement of space the first fork section must only be angled to a few degrees more than 90°—e.g. to about 100-140°. This achieves a particularly advantageous unstressed force distribution and makes possible the use of blades that are themselves rigid. The configuration is also advantageous with respect to the dimensioning, such that comparatively large first and second forks can nevertheless be used, wherein as the fork size is increased, the insulation displacement contact as a whole only increases in size in one direction.

In a second variant, the first and second fork sections lie on different sides of the cutter section plane. This variant is especially advantageous if the first fork section is angled at 180° or at another comparatively large angle—for example between 150° and 190°. The insulation displacement contact as a whole thus has the form of a bow with, for example, an approximately perpendicularly angled (second) fork, wherein the bow is formed by the first fork and the cutter section. Again, this is an advantage if the insulation displacement contact as a whole is relatively small: the cable strand can be pushed between the blades by a wiring cap that is put over the bow and approaches close to the blades; it can also be that no element, which would have to be disruptive in the small space between the fork prongs, is necessary for the wiring, i.e. only the conductor comes to rest between the blades.

If the first fork section is angled to a large angle of about 180°, a torque is also applied to it as the two blades are pushed away from one another. Therefore in the second variant the cutter section preferably is designed as (a third) spring element. This has the further advantage that potential energy can also be stored in the cutter section and thereby a plastic deformation of the insulation displacement contact can be further counteracted.

The insulation displacement contact is metallic and one-piece. Preferably, the insulation displacement contact according to the invention is manufactured out of a stamped, bent component (sheet). The deflection of the contact blades and the corresponding spring force that acts against the deflection, thus, act in the sheet plane, and not perpendicularly thereto. This has the advantage, among others, that the relevant spring constant can be nearly arbitrarily determined by the width of the fork prong sections and the arrangement of the fork bridge area, i.e. the spring constant is not exclusively dependent on the sheet thickness, but rather is an independently free parameter. Furthermore, reliable and comparatively economical manufacturing methods can be reverted to.

Also, it is preferred that the cutter section as a whole is substantially flat, i.e. at least the cutting edges and, for example, the entire cutter section runs in a plane without curvatures.

The insulation displacement contact may—particularly in uses for the wiring of comparatively thick conductors—comprise protruding contact spikes in the proximal direction, with which during wiring the insulation of thicker cable strands will be tapped. By this measure, it is made possible that the radial force needed for the penetration of the insulation is restricted to clean cutting, which is achieved particularly well with the advancement according to the invention, by which the elasticity tends to be increased in comparison to the state of the art.

Furthermore, the contact blades may—in each embodiment—be sharpened by punching in their insertion area in order to increase their cutting action.

A contacting device of the kind of the invention comprises a plurality of insulation displacement contacts according to the invention, which are arranged on and/or in one housing. The insulation displacement contacts serve either for the direct contacting of a further element (cable strand of a branched conductor or contact of a device, etc.), in which they also form a jack or plug contact (with jack or plug contact, corresponding distribution board contacts are also meant), or they are contacted and/or contactable in the housing by a jack or plug contact; the housing does not need to be one-piece and it can be imagined that an electrical connection between insulation displacement contacts and cable strands on the one side and/or between insulation displacement contacts and jack or plug contacts on the other side can be established through the bringing-together of the parts of the housing.

BRIEF DESCRIPTION OF THE DRAWINGS

Below, preferred embodiments of the invention will be described in more detail by use of figures. In the figures, identical reference numbers indicate similar or analogous elements. Depicted are:

FIG. 5 the wiring of a conductor using a variant of the insulation displacement contact according to FIG. 1 with a stepped contact area;

FIG. 6 a top view of a further variant of an insulation displacement contact with a cutter for cutting the cable to length;

FIG. 7 a schematic graph which depicts the spring force as a function of the insertion depth of the cable strand;

FIG. 8 a drawing that illustrates the course of curvature of the inner contour of a fork of an insulation displacement contact according to the invention;

FIG. 9 a drawing that demonstrates the criteria for the design of the IDC;

DETAILED DESCRIPTION OF THE INVENTION

Figure 1:
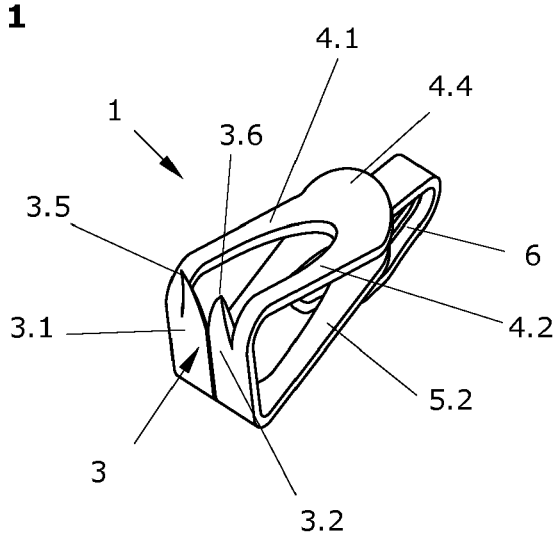
FIG. 1 a perspective view of an insulation displacement contact according to the invention.
Figure 2:
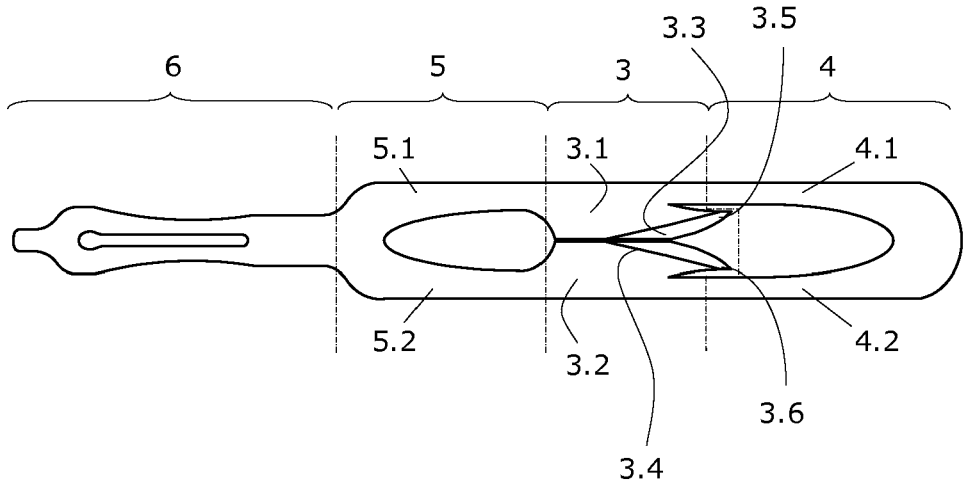
FIG. 2 a top view of the blank of an insulation displacement contact according to FIG. 1 (i.e. of the insulation displacement contact in a flat form, as it exists during manufacturing process before bending or as a semi-finished product)
Figure 3:
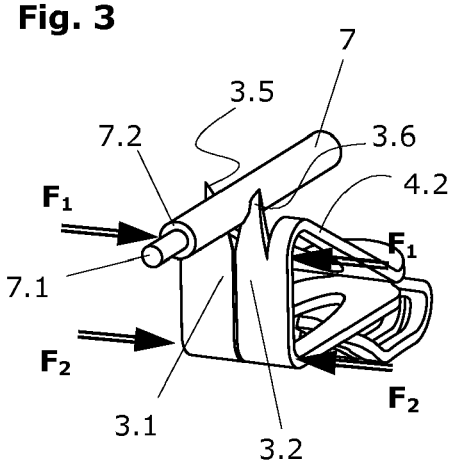
FIG. 3 the wiring of a conductor with a small diameter.
Figure 4:
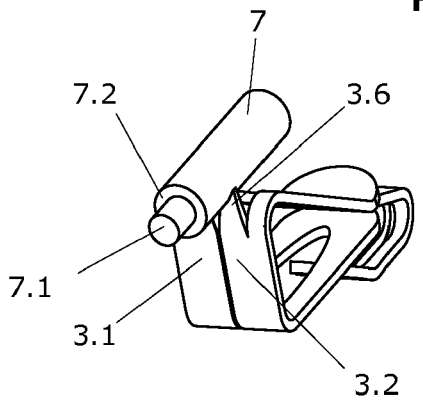
FIG. 4 the wiring of a conductor with a larger diameter.
Figure 15:
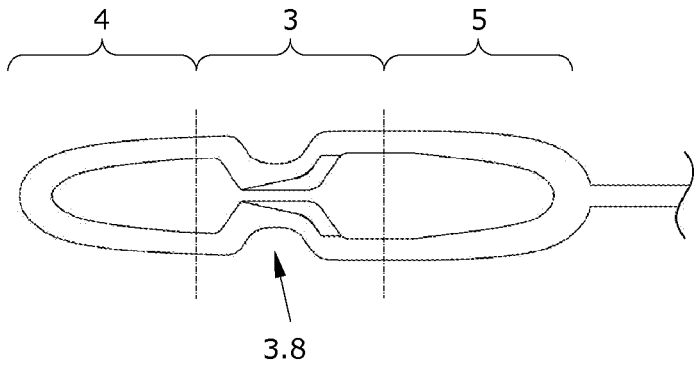
FIG. 15 a top view of a blank of an insulation displacement contact according to FIGS. 13 and 14 without the jack contact section.

The depictions of FIGS. 2 and 15 correspond to the insulation displacement contacts that are shown in FIGS. 1 and respectively 13/14 in the flat form of a blank, as they exist for example as semi-finished products before being bent into the desired 3-D form; in FIGS. 2 and 15 the bending lines (in reality they are regions around these lines) are respectively also depicted, which define the transition between the cutter section on the one side and the fork sections on the other sides.

The insulation displacement contact 1 depicted in FIGS. 1-4 comprises a cutter section 3 with two blades 3.1, 3.2. In an area of the blades, there are opposing cutting edges 3.3, 3.4 which are designed to cut through an insulation 7.2 of a conductor 7.1. In this text, "blades" will indicate whole length of the elements that make up the cutter section, thus not only in the area in which the cutting edges exist.

A first fork 4 with two fork prongs 4.1, 4.2 connects on the proximal side (in those figures where as for example in FIGS. 1, 3 and 4 a 3D-view is shown, the proximal side of the cutter section corresponds to the upper side, the distal side to the lower side; the cable strands are inserted "from above") of the cutter section 2. On the distal side, the cutter section merges into the second fork 5 with respectively two fork prongs 5.1, 5.2. The fork section that is formed by the first fork 4 is angled with respect to the cutter section by an angle of more than 90°—here approximately 115°. An end area 4.4 of the first fork section is, for reasons of space, slightly bent away from a main area of the fork section. The second fork section that is formed by the second fork 5 comprises an angle of about 90° to the cutter section. This arrangement makes possible the wiring of a through-running, uncut conductor, as will be more fully illustrated below with reference to FIG. 10.

In the illustrated embodiments, a jack contact section 6 continues on from the second fork section, which is formed in a manner appropriate to the geometric position in the contacting device, such that a plug contact of a plug can establish a dependable electrical contact.

By the insertion of a cable strand 7 (conductor 7.1 with insulation 7.2) the two blades 3.1, 3.2 are pushed apart from one another. As is shown schematically in FIG. 3 by double arrows, this pushing-apart works at four points against an elastic counter-force $F_{1,2}$, which is exerted by the fork prongs of the first and second fork. This elastic counter-force results from the forks 4, 5 being elastically deformed in their respective planes, as the fork prongs are pushed apart from one another.

In the depicted embodiment each of the two blades 3.1, 3.2 also each comprises a contacting spike 3.5, 3.6. As one can see in FIG. 4, these contacting spikes can tap into and penetrate into the cable strand insulation during the wiring of thicker cable strands 7. This contributes the positive effect that the radial (with respect to the cable strand) force that is borne through the insulation displacement contact and with this the maximal deflection of the blades away from one another during the wiring process can be reduced: as it were, at most only the inner part of the insulation must be broken through in a radial cutting movement. This characteristic thus causes the range of thicknesses that can be wired and can be done so reversibly to be further increased.

The variant of the insulation displacement contact that is depicted in FIG. 5 is distinguished from the insulation displacement contact according to FIG. 1 in that the cutting edges are stepped, thus in an upper, proximal section are more distant from one another than in a lower section. By this means, the range of possibly manageable cable strand thicknesses can be yet further enlarged: thin cables are pushed completely to the bottom, while thicker cables remain in the upper area.

The variant according to FIG. 6 has further the characteristic that a length-cutting blade 8 for cutting the cable strand 7 to length is present; this variant is advantageous in combination with the utilization of non-through-running cables. At the jack contact section 6 (in other embodiments it can also be a plug contact section) other elements for yet further functions can be present, for instance soldering pins, springs, etc.

In FIG. 7 the solid line shows schematically the force F exerted by the blades on the conductor as a function of the insertion distance s of the cable strand, wherein for an insulation displacement contact the descriptions depicted in FIGS. 1-4 are assumed. Due to the slanted form of the blades in the proximal area, the blades are at first steadily pushed away from one another, which according to Hooke's Law produces an analogous, for example linear, rise in the force. However, as soon as the conductor is in the area in which the cutting edges of the blades are parallel to one another and the insulation at the contact point with the IDC is broken through, the force F remains constant, since the two forks are not further deformed by further insertion.

This markedly distinguishes the insulation displacement contact according to the invention from known insulation displacement contacts (V-technology), these insulation displacement contacts are in the form of a pair of scissors, between whose blades an object is inserted, and which in the course of this insertion open ever wider. A corresponding force curve of a cutter according to the state of the art is shown schematically in FIG. 7 by the dotted line: the force steadily increases as a function of the insertion distance. As a result, in the area of the apex of the state of art insulation displacement contact forces will arise very rapidly and exceed the elastic range even with a normal conductor cross section, and rapid and inevitable plastic deformation will also ensue. A boundary between elastic (reversible) and plastic (irreversible) deformation—in practice naturally fluid and furthermore dependent on the geometrical design of the insulation displacement contact—is illustrated in FIG. 7 by a dashed line.

Preferred embodiments of the insulation displacement contacts according to the invention are furthermore optimized through further means, which make possible as large as possible a spring area of the forks in as small a space as possible. So as depicted in FIG. 8 the forks are preferably distinguished from the forms realized in the state of the art with round inner contour lines in the area of the apex and adjoining thereto parallel fork prongs of constant cross sectional area. In particular, the curvature will preferably not be constant at least in the area of the apex, but rather decrease as a function of distance from the apex.

This is expressed in that, among other things, the following criterion is fulfilled. If at the apex a circle of curvature (dotted in FIG. 8) with radius $r_{Si}$ is drawn and tangents (and/or tangential planes 31.1, 31.2) are drawn for the inner contour line at a distance of $r_{Si}$, from the apex (i.e. in x-direction in FIGS. 8 and 9), the angle between the tangents becomes non-zero. This angle amounts to, for example, at least 10°, or at least 30°, in the depicted example somewhat more than 60°, and preferably its maximum is about 100°.

Analogous considerations can be valid for the outer contour lines, wherein it is particularly advantageous for the outer contour lines if they depart from a form that can be approximated by three rectangular sides with rounded edges between them.

It can further be seen in FIG. 8 that the width of the fork prongs decreases as a function of the distance from the apex—i.e. as a function of the x-coordinate in FIG. 8.

FIG. 9 depicts further criteria for the inner contour line 21.1 and the outer contour line 21.2, which to a greatest possible degree represent an optimization of the elastic spring range of the forks in the smallest possible space. Virtual planes 41 and 42, which are designed with an angle of 45° to the plane of symmetry 40 (and perpendicular to the plane of the image) are placed through the apex of the inner contour line 21.1 and the outer contour line 21.2 respectively.

The distance m between on the one side the point of intersection of the virtual plane 41 through the inner apex and the inner contour line 21.1, and on the other side the plane of symmetry 40 represents in classical solutions the half distance d/2 of the two fork prongs at their widest point. According to a preferred embodiment of the invention, m is smaller than this value, for example to a minimum of d/12, particularly preferably to a minimum of d/8 such that it is true that $m \leqq 3d/8$. This criterion also means the maximum distance of the inner contour lines from the plane of symmetry does not already occur near the apex, but rather is displaced from there.

A realistic lower limit for the value of m lies at, for example, d/12, particularly preferably at a minimum of d/8.

Also for the distance n between on the one hand the point of intersection of the virtual plane 42 through the outer apex with the outer contour line 21.2 and on the other hand the plane of symmetry 40 there is—independently—a criterion. In the "classical" solution this amounts to p/2, wherein p/2 is the maximum distance of the outer contour lines from the plane of symmetry. According to the preferred embodiment of the invention, n is yet smaller than p/2 particularly preferably n is not larger than 7p/16. As a lower limit for n the value of p/4 can, for example, be taken.

In a blank of the insulation displacement contact, the planes 41, 42 are replaced by corresponding lines 41, 42, which stand at an angle of 45° to the tangent 43 and/or 44 of the corresponding apex, wherein the distance is then measured from the intersection to the perpendicular 40 of the tangent 43 and/or 44 through the apex; this definition is also valid for non-symmetrically shaped insulation displacement contacts.

Figure 10:
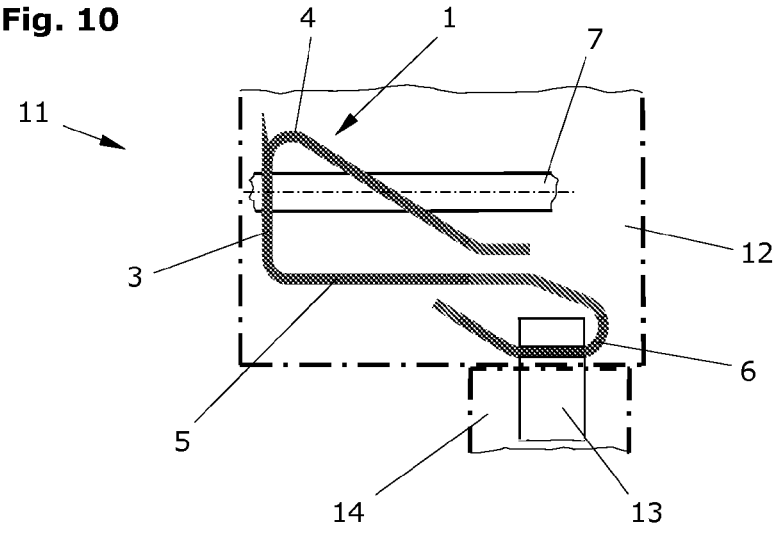
FIG. 10 a schematic depiction of a contacting device according to the invention.

FIG. 10 shows schematically a contacting device with an insulation displacement contact 1 as described above. In FIG. 10, one may also see that on the basis of the selected angle between the cutter section 3 on the one side and the fork sections 4, 5 on the other side a through-running cable strand 7 may be contacted.

In a addition to a plurality of insulation displacement contacts 1, the device comprises a housing 12. This housing is designed such that the plug contact 13 of a plug 14 can project into the housing interior such that the jack contact section 6 of the insulation displacement contact 1 can be contacted.

Ways of arranging the housing of such a contacting device 11 as well as means of guiding the conductor (guiding ridges, etc.) and aids for wiring (for example inclinable or translationally movable wiring caps, etc.) are known to those skilled in the art, and will not be dealt with here in further detail. Of course, other embodiments can be imagined, in which the insulation displacement contact can be designed in and/or on an inclinable or movable element and in the wiring process be moved relative to the stationary cable strand.

Figure 11:
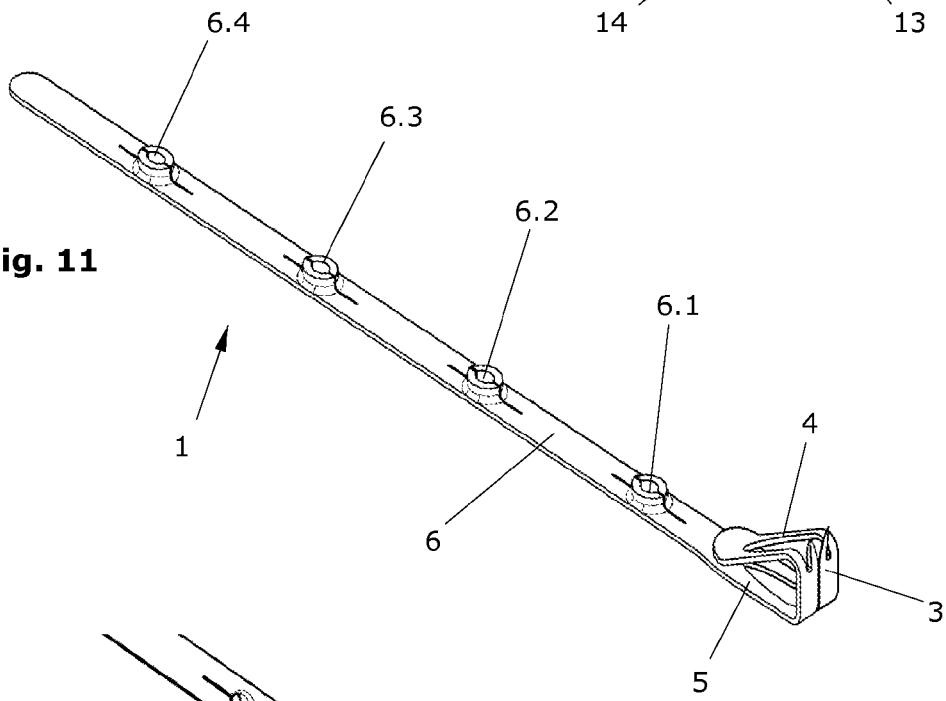
FIGS. 11 and 12 each a view of a further insulation displacement contact according to the invention, which is particularly appropriate for multiple distributor banks.
Figure 12:
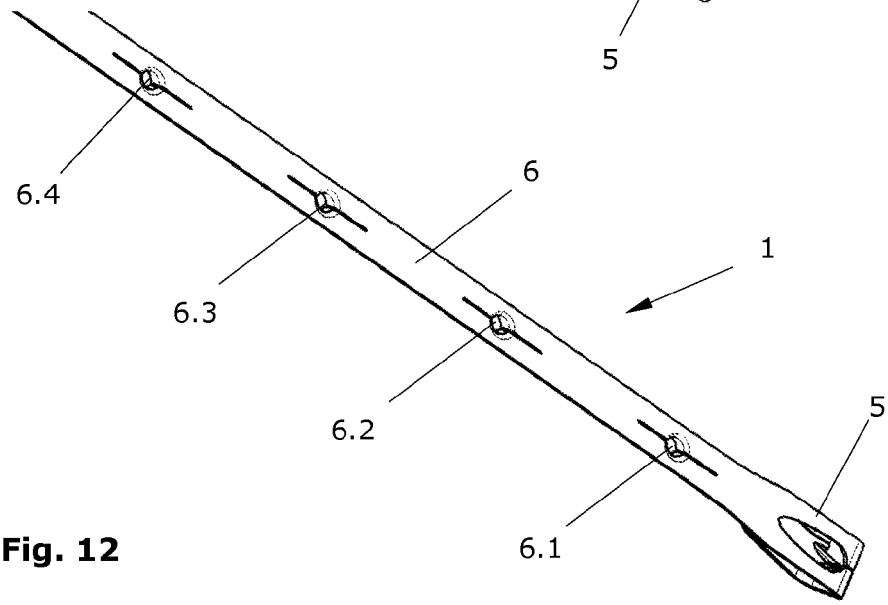

The insulation displacement contact according to FIGS. 11 and 12 is distinguished from the one of FIGS. 1 to 4 in that is, for example, specially designed as a contacting device for a multiple-socket connector strip. In the jack contact area 6 multiple jack contact holes 6.1-6.4 are designed, in which, respectively one cylindrical plug contact can be inserted. The slits in the area of the jack contact holes provide the necessary elasticity for the case in which the plug contact itself is rigid. In a plug strip there are two or three, or depending on the plug standard also more, insulation displacement contacts of the type depicted in FIGS. 10 and 11, wherein the arrangement can be such that the jack contact holes 6.1-6.4 of the different insulation displacement contacts are designed to correspond to a prevalent type of plug.

In place of jack contact holes, or in addition to these, other means of connection can be imagined, for example soldering eyelets or pins, piercing points, etc.

Figure 13:
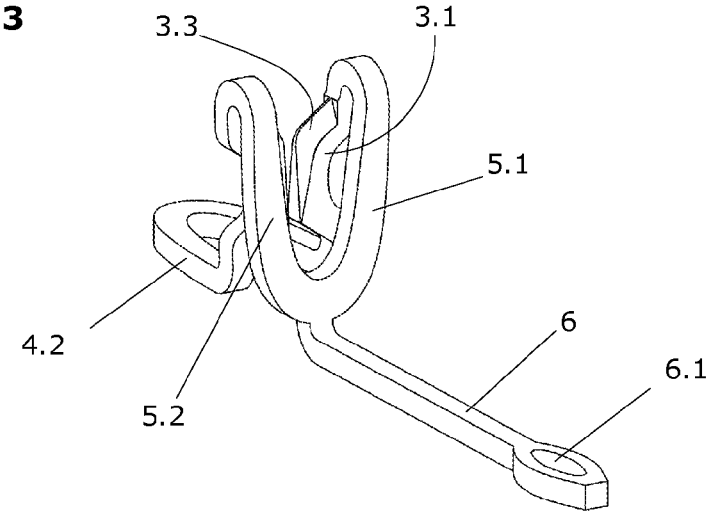
FIGS. 13 and 14 each a view of a further insulation displacement contact according to the invention.
Figure 14:
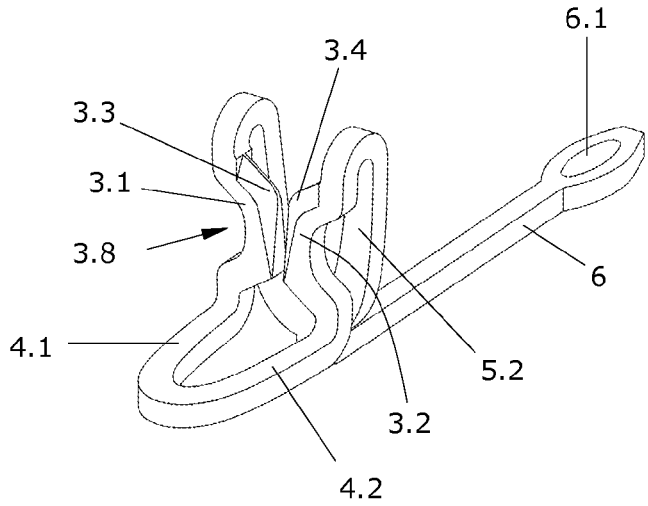

The insulation displacement contact according to FIGS. 13-15 is distinguished from the one of FIGS. 1-4 in that, among other things, the first and second fork are angled on different sides of a plane defined by the cutter section. In this manner, as can also be seen in FIGS. 13 and 14, the second fork section can be angled to approximately 180°, such that the cutter section 3 and the second fork section 5 together form a bow with two bow limbs, the first fork limb 5.1 together with the first blade 3.1 forming the first bow limb, and the first fork limb 5.2 together with the first blade 3.2 forming the second bow limb. Between the bow limbs, a cable strand with the conductor to be contacted must be inserted. This can be achieved with the help of a wiring cap, which for example, can be put over the bow. The form of the insulation displacement contact according to FIGS. 13-15 is thus also particularly appropriate for the design of a comparatively smaller insulation displacement contact, so for example for the wiring of data conductors. In particular a contacting device according to the invention can be designed as the plug or jack of a data conductor, for example as an RJ-45 plug or jack.

A further characteristic of the insulation displacement contact according to FIGS. 13 to 15 is distinguished in the notches 3.8 that can be seen in the cutter section. As a result of this notch, the blades 3.1, 3.2 concurrently function as spring elements in the same manner as the forks. They can, thus, contribute to the elasticity of the insulation displacement contact as a whole and in addition take up the torsion forces that are caused by the angling of the two forks 4, 5 relative to one another.

What is claimed is:

1. An insulation displacement contact for the wiring of a cable strand, comprising:

a cutter section comprising two contact blades between which the insulation-surrounded conductor of the cable strand can be inserted by a movement relative to the insulation displacement contact in a wiring direction in the direction of a distal end of the cutter section, whereby the contact blades cut into the insulation and contact the conductor, wherein the contact blades are disjoined from one another throughout a region of the cutter section;

a first fork section comprising a first fork with two first fork prongs;

and a second fork section comprising a second fork with two second fork prongs;

wherein the first fork section and the second fork section each are angled relative to the cutter section;

wherein ends of the fork prongs of the first fork adjoin to a proximal end of the cutter section, whereby the first fork furnishes a contrary elastic spring force upon the moving apart of the proximal ends of the contact blades;

and wherein ends of the fork prongs of the second fork adjoin to a distal end of the cutter section and the second fork furnishes a contrary elastic spring force upon the moving-apart of the distal ends of the contact blades.

2. The insulation displacement contact according to claim 1, wherein spring constants of the elastic force exerted on the proximal ends of the cutter section by the first fork and of the elastic force exerted on the distal ends of the cutter section by the second fork differ by at most a factor of 3.

3. The insulation displacement contact according to claim 2, wherein the spring constants of the elastic force exerted on the proximal ends of the cutter section by the first fork and of the elastic force exerted on the distal ends of the cutter section by the second fork differ by at most a factor of 2.

4. The insulation displacement contact according to claim 3, wherein the spring constants of the elastic force exerted on the proximal ends of the cutter section by the first fork and of the elastic force exerted on the distal ends of the cutter section by the second fork differ by at most a factor of 1.5.

5. The insulation displacement contact according to claim 1, wherein the fork prongs of the first fork run non-parallel, or the fork prongs of the second fork run non-parallel, or both, the fork prongs of the first and of the second fork run non-parallel.

6. The insulation displacement contact according to claim 1, wherein for at least one of the first fork and of the second fork, in a blank of the insulation displacement contact, for a distance m between on the one side the point of intersection of the inner contour line with a line which passes through the apex and is at an angle of 45° to the tangent of the apex, and on the other side the perpendicular to the named tangent, the relation $m \leqq 3d/8$ holds, wherein d is the distance between points on the inner contour line at the site of the greatest distance between the fork prongs.

7. The insulation displacement contact according to claim 1, wherein for at least one of the first fork and of the second fork, in a blank of the insulation displacement contact for a distance n between on the one side the point of intersection of the outer contour line with a line which passes through the apex and is at an angle of 45° to the tangent of the apex, and on the other side the perpendicular to the named tangent, the relation $p/4 \leqq n < p/2$ holds, wherein p is the distance between points on the outer contour line at the site of greatest distance between the fork prongs.

8. The insulation displacement contact according to claim 1, wherein the first and second fork sections are angled with respect to the cutter section such that relative to a cutter-section plane they lie on the same side of the cutter section.

9. The insulation displacement contact according to claim 6, wherein the first and second fork sections are angled with respect to the cutter section such that relative to a cutter-section plane they lie on different sides of the cutter section.

10. The insulation displacement contact according to claim 1, wherein the cutter section forms an additional spring element in addition to the first fork section and to the second fork section.

11. The insulation displacement contact according to claim 1, wherein the first fork section is angled from the cutter section by more than 90° and wherein the second fork section is angled from the cutter section by approximately 90°, such that a straight, through-running cable strand can be contacted.

12. The insulation displacement contact according to claim 1, wherein the contact blades each comprise a proximally-projecting contacting spike for tapping into a cable insulation of the cable strand that is to be contacted.

13. The insulation displacement contact according to claim 1, wherein a clamping force between the contact blades is approximately independent from the position of the cable strand with respect to the wiring direction.

14. The insulation displacement contact according to claim 1, wherein during the process of contacting the conductor the contact blades are approximately parallel while being pushed apart from one another, such that a gap between the contact blades at a proximal and at a distal location is approximately independent from the position of the cable strand in the wiring direction.

15. The insulation displacement contact according to claim 1, wherein the contact blades comprise stepped cutting edges for the acceptance of cables of diverse diameters.

16. The insulation displacement contact according to claim 1, further comprising additional functional elements integrally formed on at least one fork, the additional functional elements being equipped for further functions, and for example being soldering pins, contact springs, length cutters or terminals.

17. A contacting device, comprising: a housing; guiding means for guiding a plurality of cable strands; a plurality of jack or plug contacts that are housed in the housing, further comprising a plurality of insulation displacement contacts according to claim 1, wherein the jack or plug contacts are each in electrical contact with one of the insulation displacement contacts or can be brought into electrical contact therewith, or wherein the jack or plug contacts are each formed by one of the insulation displacement contacts.

* * * * *